US007384533B2

(12) United States Patent
Sierakowski et al.

(10) Patent No.: US 7,384,533 B2
(45) Date of Patent: Jun. 10, 2008

(54) ELECTROLYTIC PROCESSES WITH REDUCED CELL VOLTAGE AND GAS FORMATION

(75) Inventors: Michael J. Sierakowski, Stillwater, MN (US); L. Charles Hardy, St. Paul, MN (US); Michael S. Terrazas, Prescott, WI (US); Jennifer E. Waddell, Monument, CO (US); Bryan J. Johnson, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 536 days.

(21) Appl. No.: 10/192,335

(22) Filed: Jul. 10, 2002

(65) Prior Publication Data

US 2003/0111349 A1 Jun. 19, 2003

Related U.S. Application Data

(60) Provisional application No. 60/307,560, filed on Jul. 24, 2001.

(51) Int. Cl.
*C25C 1/12* (2006.01)

(52) U.S. Cl. ..... 205/574; 205/576; 205/578; 205/585

(58) Field of Classification Search ..... 205/585, 205/67, 574, 296
See application file for complete search history.

(56) References Cited

U.S. PATENT DOCUMENTS

| | | | | |
|---|---|---|---|---|
| 3,725,214 | A * | 4/1973 | Bride | 205/120 |
| 4,169,772 | A * | 10/1979 | Lowery et al. | 205/312 |
| 4,279,711 | A * | 7/1981 | Vining et al. | 205/341 |
| 4,484,990 | A | 11/1984 | Bultman et al. | |
| 4,608,136 | A | 8/1986 | Vaughan | |
| 5,145,572 | A | 9/1992 | Hupe et al. | |
| 5,340,380 | A * | 8/1994 | Virnig | 75/744 |
| 5,468,353 | A * | 11/1995 | Anich et al. | 205/581 |
| 5,820,653 | A * | 10/1998 | Eamon et al. | 75/743 |
| 6,217,738 | B1 * | 4/2001 | O'Driscoll | 205/302 |
| 6,258,245 | B1 | 7/2001 | Cifuentes et al. | |
| 6,261,526 | B1 * | 7/2001 | Virnig et al. | 423/139 |
| 6,298,996 | B1 * | 10/2001 | Spiegel et al. | 205/754 |
| 6,508,927 | B2 * | 1/2003 | Yanada et al. | 205/241 |

FOREIGN PATENT DOCUMENTS

WO WO 00/65131 11/2000

OTHER PUBLICATIONS

F. A. Lowenheim, Electroplating, McGraw-Hill Book Co., New York, 1978, pp. 5-7, 152-155.*

Article: Sandoval et al., "A Substituted Anode Reaction for Electrowinning Copper," Proceedings of Copper 95-Cobre 95 International Conference, vol. III, Electrorefining and Hydrometallurgy of Copper, Edited by W. C. Cooper et al., (1995), pp. 423-435.

Book Excerpt: ASM International Handbook Committee, "Corrosion," ASM Handbook; Formerly Ninth Edition, Metals Handbook, vol. 13, (1987), pp. 765-767.

Book Excerpt: Winand, "Electrodeposition of Zinc and Zinc Alloys," *Modern Electroplating*, Fourth Edition, John Wiley & Sons, Inc., (2000), pp. 423-460.

Book Excerpt: ASM Handbook Committee, "Surface Cleaning, Finishing, and Coating," *Metals Handbook Ninth Edition*, vol. 5, (1982), p. 319.

Book Excerpt: "Applications of Electrodeposition in Environmental Remediation," *Modern Electroplating*, Fourth Edition, John Wiley & Sons, Inc., (2000), pp. 806-808.

Book Excerpt: "Electrodeposition of Copper-Part A—Addition Agents," *Modern Electroplating*, Fourth Edition, John Wiley & Sons, Inc., (2000), pp. 67-71.

Article: Subbaiah et al., "Sulphurous Acid as Anodic Depolarizer in Copper Electrowinning Part II," *Journal of Applied Electrochemistry*, vol. 30, (2000), pp. 181-186.

Book Excerpt: Lupi et al., "Energy Saving in Copper Electrowinning," *Aqueous Electrotechnologies Progress in Theory and Practice*, Edited by D. B. Dreisinger, The Minerals, Metals & Materials Society, (1997), pp. 19-26.

Article: Lupi et al., "New Lead Alloy Anodes and Organic Depolariser Utilization in Zinc Electrowinning," *Hydrometallurgy*, vol. 44, (1997), pp. 347-358.

Article: Ramachandran et al., "Electrolyte Additives for Improved Behaviour of Anodes in Electrowinning of Metals," *Trans. Indian Inst. Met.*, vol. 49, No. 6, Dec. 1996, pp. 789-794.

Paper: Conard et al., "Copper Electrometallurgy," Prepared for Copper Hydrometallurgy, Copper 95—Cobre 95, Nov. 25-26, 1995, pp. 4-89.

Paper: Dolinar et al. "Copper Electrowinning in the Absence of Acid Misting Using the Ferrous/Ferric-Sulfur Dioxide Anode Reaction—A Pilot Study," For Presentation at the SME Annual Meeting, Denver, CO, Mar. 6-9, 1995, pp. 1-11.

Research Summary: Gonzalez-Dominguez et al., "Evaluating Additives and Impurities in Zinc Electrowinning," *Journal of Metals*, Jan. 1995, pp. 34-37.

Article: Robinson, "$SO_2$ Electrowinning in Copper Hydrometallurgy for Energy Conservation," *Journal of Metals*, Jan. 1984, pp. 43-47.

Article: Pace et al., "Direct Electrowinning of Copper from Synthetic Pregnant Leach Solutions Utilizing $SO_2$ and Graphite Anodes—Pilot-Plant Results," *CIM Bulletin*, Jan. 1974, pp. 85-90.

* cited by examiner

*Primary Examiner*—Susy Tsang-Foster
*Assistant Examiner*—William T. Leader

(57) ABSTRACT

Electrolytic solutions containing organic additive(s) selected from a described class of additives (e.g., 4,6-dihydroxypyrimidine) reduce overall applied electrical potential of electrolytic cells and/or reduce gas formation at the anode(s) or increase copper production rate. Benefits include reducing overall power consumption and reducing acid mist during electrolytic processes.

19 Claims, No Drawings

ELECTROLYTIC PROCESSES WITH REDUCED CELL VOLTAGE AND GAS FORMATION

CROSS REFERENCE TO RELATED APPLICATION

This application claims priority to U.S. Provisional Patent Application No. 60/307,560, filed Jul. 24, 2001.

FIELD OF THE INVENTION

The present invention relates to electrolyte solutions comprising at least one organic additive and to methods of reducing cell operating potential at constant current in electrolytic processes, or alternatively increasing metal deposition rate at constant voltage in electrolytic processes. Additionally, the present invention is related to methods of reducing gas evolution and acid mist formation during electrolytic processes.

BACKGROUND OF THE INVENTION

There are a variety of electrolytic processes that use gas-evolving electrode(s), such as copper electrowinning, zinc electrowinning, manganese electrowinning, electrogalvanizing, copper foil production, metal finishing, and metal recovery. In these processes, the rate of metal deposition is proportional to the current, but significant energy is expended owing to an over-potential at the gas evolving anode. The application of an electrical potential across the electrodes causes the movement of ions in the electrolyte and the movement of electrons from the anode to the cathode to complete the electrical circuit. This flow of electrons is accomplished by the removal of electrons from the anode with the supply of electrons at the anode provided by negatively charged anions, such as chloride, or reducing agents in the electrolyte solution.

Some anions, such as sulfate, are not discharged directly from aqueous solutions, so completion of the circuit in this instance requires the use of a reducing agent as the source of electrons. The potential required for the discharge of this reducing agent is dependent on the reversible (equilibrium) potential of that particular species. In a sulfuric acid/copper sulfate electrolyte for example, using an insoluble lead/lead oxide anode, water is the primary source of electrons for completion of the circuit with the subsequent evolution of oxygen gas.

In practice, the actual voltage required to produce gas evolution at the anode is considerably higher than just the equilibrium potential. This difference is called the overvoltage, and is caused by the irreversible reaction of the formation of oxygen bubbles on the surface of the anode. This overvoltage can increase the operating potential of the cell by as much as 1 volt, depending on the specific electrode array in use. Since energy consumption in electrolytic processes is directly proportional to the operating potential of the cell, lowering the cell voltage will have a significant impact on the energy consumption and corresponding manufacturing costs related to these electrolytic processes.

Reducing the energy requirement of the electrolytic cell is also desirable. There have been attempts to reduce the overall energy requirement of the electrolytic process. For example, the oxidation potential at the anode of an electrowinning cell has been decreased by using titanium anodes coated with a layer containing platinum metals (i.e., "dimensionally stable anodes" (DSA)) instead of lead/lead oxide anodes. But DSA anodes are relatively expensive.

Inorganic materials have previously been added to electrowinning processes to reduce the overall cell voltage in addition to reducing oxygen gas byproduct, thus reducing acid mist. For example, an Fe(II)/Fe(III) couple, combined with sulfur dioxide to reduce Fe(III) to Fe(II), was used to decrease cell voltage from 2.00 V to 0.94 V and also to reduce acid mist. But these effects were only seen using the DSA anodes, not with the more prevalent lead/lead oxide anodes. (See, S. P. Sandoval et al., "A Substituted Anode Reaction for Electrowinning Copper," Proceedings of COPPER 95-COBRE 95 International Conference, Volume III—Electrorefining and Hydrometallurgy of Copper, edited by W. C. Cooper, et al., pp. 423-435).

Another problem inherent with the use of gas-evolving anodes is that gas is produced, which agitates the electrolyte solution and may cause acid mist. Acid mist may be harmful to the health of the electrolytic process workers. Another problem with some electrolytic processes is the amount of electrical potential or energy required, and the related expense.

An electrolytic process generally takes place in an electrolytic cell. An electrolytic cell typically comprises at least one anode and at least one cathode. The anode(s) and cathode(s) (or electrodes) are in contact with an electrolyte solution. Gas-evolving anodes are insoluble in the electrolyte solution. A highly pure metal is deposited on a cathode.

During these electrolytic processes, metal is reduced at the cathode(s) and oxidation occurs at the insoluble anode (s). Gas bubbles may be formed at the anode(s) and may rise upwardly toward the electrolyte solution surface and burst, thereby forming a mist aerosol of finely dispersed electrolyte droplets. This mist, or aerosol, then typically spreads throughout the area where the electrolytic cells are operated, sometimes called the tank house. The composition of the mist is dependent on the composition of the electrolyte solution, and typically contains sulfuric acid and metal salts. The acid mist is corrosive to equipment and may be a health hazard. The acid mist may cause extreme discomfort to the skin, eyes, and respiratory systems of tank house workers.

Thus, various methods have been used to either contain or inhibit the generation of acid mist by electrolytic cells. But no method is completely satisfactory.

One common method used to address the problem of acid mist is to use a powerful ventilation unit to remove contaminated air from a tank house. The air is then circulated through a scrubber to remove contaminants before it is either recirculated or released into the environment. This method consumes a lot of energy and is not very effective at removing the acid mist.

Another common attempt to suppress acid mist formation has been to use mechanical interference devices. Common examples of mechanical interference devices are layers of floating plastic balls, beads, discs, rods etc., in the electrolyte solution. These devices create a surface where gas bubbles can burst less violently and also provide a surface where the acid mist from the bursting gas bubbles may be collected and drained back into the electrolyte solution.

Another method of addressing the acid mist problem has been to apply certain fluorochemical surfactants to form a "foam blanket" on the surface of the electrolyte solution, to reduce the electrolyte solution's surface tension, and to reduce the intensity of acid mist breakout. (See, for example, U.S. Pat. Nos. 4,484,990 and 5,468,353). But a uniform thickness of the foam blanket can be difficult to maintain. Acid mist may escape in areas where the foam is too thin.

Also, the foam layer may become too thick and thus interfere with the electrical contacts of the cell.

Other attempts to reduce acid mist generation have included providing a fabric screen or some kind of a cover over the electrode plates where the plates extend above the surface of the electrolyte solution. (See, for example, WO/0065 131). These attempts, however, have been ineffective in preventing acid mist generation.

SUMMARY OF THE INVENTION

The present invention provides electrolytic processes utilizing an electrolytic cell having at least one gas-evolving anode, at least one cathode, and an electrolyte solution in contact with the anode and cathode, with an electric voltage potential applied across the anode and cathode, said electrolyte solution comprising an acid, a metal ion source a solvent and at least one organic additive, which advantageously reduces cell operating potential (thereby enabling significant reduction in energy consumption) and/or gas generation at gas-evolving anode(s). The present invention can decrease acid mist and can also save energy, and in turn operating costs.

The organic additive is, in general: (i) soluble in the electrolyte solution; (ii) present in an amount sufficient to reduce gas evolution during an electrolytic process at a gas-evolving anode in contact with the electrolyte solution as compared to the same process without the organic additive; and (iii) selected from the group consisting of: organic compounds soluble in the electrolyte solution which have at least one hydroxy group, excluding ethylene glycol, ethanol, and dextrin;

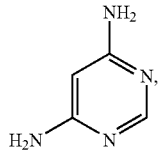

4,6-diaminopyrimidine,

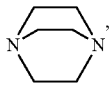

1,4-diazabicyclo[2.2.2]octane,

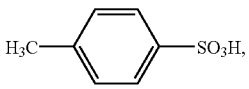

4-toluenesulfonic acid,

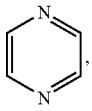

pyrazine,

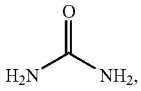

urea,

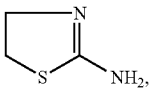

2-amino-2-thiazoline,

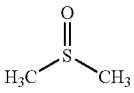

methyl sulfoxide and

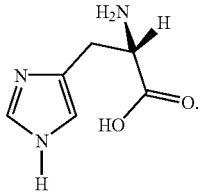

L-histidine.

The process and electrolytes described herein are advantageous in electrowinning of metals such as copper and zinc. In electrolytic processes, such as electrowinning, the inventive electrolyte solutions reduce gas evolution at the anode, and subsequent formation of bubbles rising to the surface of the electrolyte, and also the formation of acid mist.

The electrolyte solutions described herein and electrolytic cells containing them are considered part of this invention.

DETAILED DESCRIPTION OF ILLUSTRATIVE EMBODIMENTS

The present invention provides electrolytic processes with solutions having at least one organic additive for reducing the operating potential of an electrolytic cell or for reducing or eliminating gas evolution at a gas-evolving anode. A gas-evolving anode is defined herein as an insoluble anode (such as those mentioned in the Background section above) at which, under normal operating conditions in an electrolytic process without the organic additives of this invention, gas, such as $O_2$, is evolved. This reduction of cell potential and reduction of gas advantageously reduces or eliminates acid mist formation. In addition, the present invention relates to electrolytic processes having one or more gas-evolving electrode(s).

Advantageously, some organic additives of the inventive electrolytic process also reduce the cell operating potential at constant current. The cell operating potential is defined herein as the potential needed to deposit the metal ion source on the cathode as metal. Thus, the present invention also provides electrolyte solutions and methods that not only reduce gas evolution at the gas-evolving anode, but also reduce cell operating potential at constant current.

In general, an electrolytic or electrochemical cell is an electrochemical device where electrolysis occurs when an electric current is passed through it. At least one anode and at least one cathode (i.e., the electrodes) are in contact with the electrolyte solution. An electrolyte solution generally comprises acid, metal ion source, and a solvent (typically water). The metal ion source dissociates within the electrolyte solution. When a gas-evolving anode is used, gas is generated during the electrolytic process. This gas, typically $O_2$, can form an acid mist. The electrolyte solution of the present invention comprises acid, metal ion source, solvent, and at least one organic additive. The additive may be added before or after an electrical potential is applied between the cathode(s) and anode(s).

The present invention is useful for electrolytic processes where gas is evolved at the anode(s) and/or where the reduction of electrical cell potential at a constant current is desired. These electrolytic processes include, but are not limited to, copper electrowinning, zinc electrowinning, manganese electrowinning, electrogalvanizing, copper foil production, metal finishing, and metal recovery.

Acid

The electrolyte solution comprises an acid. The choice of acid depends on the electrolytic process. For example, suitable acids for copper and zinc electrowinning and copper foil production include, but are not limited to, sulfuric acid and fluoroboric acid ($HBF_4$). Typically the acid concentration ranges from about 0.1 M to about 6 M (about 10 g/L to about 600 g/L).

Metal Ion Source

The electrolyte solution of the present invention comprises at least one metal ion source. Typically the metal ion source is a metal salt (including complex metal ions) or chromic acid. The metal ion source is process dependent. For example, for copper electrowinning, copper sulfate is typically used. Zinc sulfate is typically used for zinc electrowinning. Manganese sulfate is typically used for manganese electrowinning. Chromic acid is often used as the metal ion source for chromium plating. Typically, the metal ion source concentration ranges from about 0.01 M to about 2 M (about 0.5 g/L to about 120 g/L metals basis).

Solvent

The electrolyte solution comprises a solvent or a solvent system. The most common solvent used is water. Other suitable solvents include polar organic solvents, or polar aprotic organic solvents. A polar solvent is defined herein as one that has a dielectric constant greater than 25 at room temperature. An aprotic solvent is defined herein as a solvent that does not donate protons readily. These solvents have no active hydrogen atom (e.g., a hydroxy, carboxy, sulfoxy, or amino functionality).

Examples of suitable polar organic solvents include, but are not limited to, acetonitrile, dimethylacetamide (DMA), sulfolane, dimethylsulfone, hexamethylphosphoramide (HMPA), and the like.

Additive

The organic additives must be soluble in the other components of the electrolyte solution at levels making them effective to reduce cell potential or gas evolution. Typically, organic additive concentration is in the range of 100 ppm to 50,000 ppm (5 weight percent), preferably in the range of 100-20,000 ppm, and more preferably 100-10,000 ppm. The additives preferably are non-volatile (i.e., the vapor pressure of the additive in the electrolyte solution is less than the vapor pressure of the overall electrolyte solution) and non-flammable (i.e., having a flashpoint less than 38° C.). The additives preferably do not cause an undesirable build-up of additive or a derivative of the additive on the anode that would undesirably decrease current efficiency or shorting of the cell.

Useful organic additives include those having at least one hydroxy group. A hydroxy group is defined herein as an —OH group attached to an aromatic or aliphatic backbone, or nitrogen atom. Examples of useful organic additives having at least one hydroxy group include, but are not limited to:

Group I

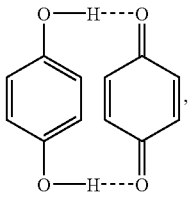

quinhydrone,

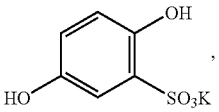

1,4-dihydroxybenzene-5-sulfonic acid, potassium salt,

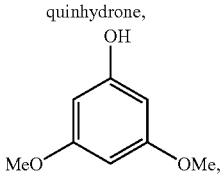

3,5-dimethoxyphenol,

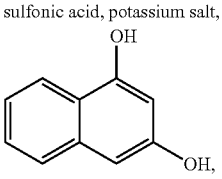

1,3-dihydroxynaphthalene,

-continued

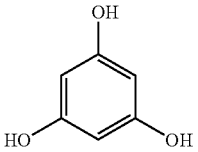

phloroglucinol dihydrate,

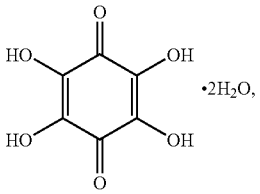

tetrahydroxy-1,4-quinone hydrate,

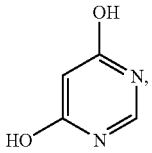

4,6-dihydroxypyrimidine,

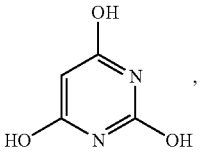

2,4,6-trihydroxypyrimidine,

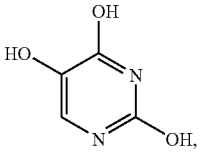

2,4,5-trihydroxypyrimidine,

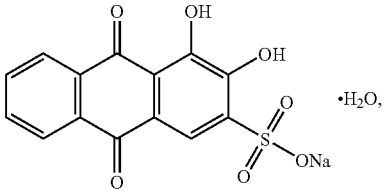

3,4-dihydroxy-9,10-dioxo-2-anthracenesulfonic acid, sodium salt monohydrate,

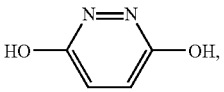

3,6-dihydroxypyridazine,

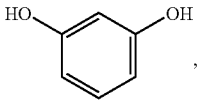

1,3-dihydroxybenzene,

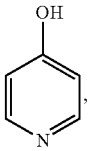

4-hydroxypyridine,

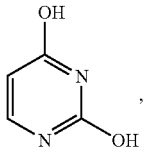

2,4-dihydroxypyrimidine,

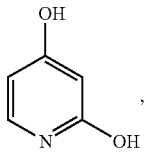

2,4-dihydroxypyridine,

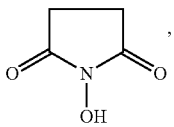

N-hydroxysuccinimide,

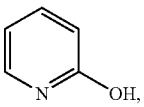

2-hydroxypyridine,

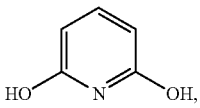

2,6-dihydroxypyridine,

-continued

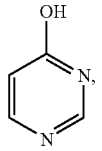

4-hydroxypyrimidine,

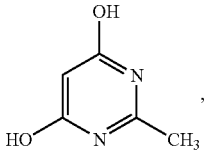

4,6-dihydroxy-2-methylpyrimidine,

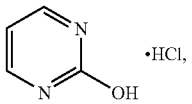

2-hydroxypyrimidine hydrochloride,

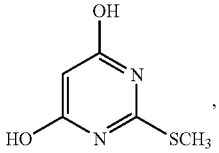

4,6-dihydroxy-2-methylmercaptopyrimidine,

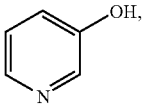

3-hydroxypyridine,

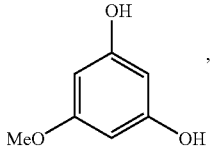

1,3-dihydroxy-5-methoxybenzene,

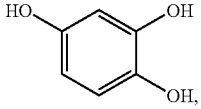

1,2,4-trihydroxybenzene,

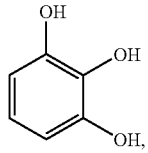

1,2,3-trihydroxybenzene,

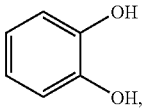

1,2-dihydroxybenzene,

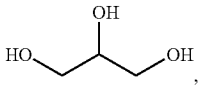

glycerol, , $CH_3OH$, glucose, sucrose, and mixtures thereof.

Suitable oraganic additives also include those additives selected from the group consisting of: Group II

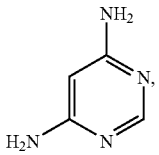

4,6-diaminopyrimidine,

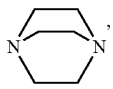

1,4-diazabicyclo[2.2.2]octane,

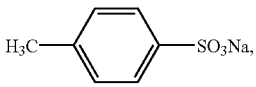

4-toluenesulfonic acid, sodium salt,

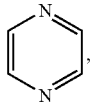

pyrazine,

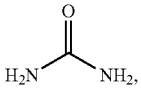

urea,

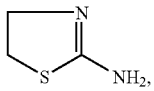

2-amino-2-thiazoline,

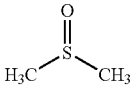

methyl sulfoxide and

-continued

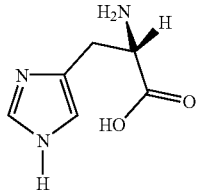

L-histidine.

and mixtures thereof.

Preferred organic additives from the above listed ones are Groups I and II without 2,4,5-trihydroxypyrimidine and pyrazine.

Some of the organic additives of the present invention can reduce the cell operating voltage potential at a constant current. Suitable organic additives that reduce the cell operating potential include those in Groups I and II, except for 2,4,6-trihydroxypyrimidine, 2,6-dihydroxypyridine, and 4,6-dihydroxy-2-methymercaptopyrimidine.

Preferred organic additives for reducing cell operating potential include:

Group III

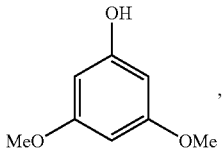

3,5-dimethoxyphenol,

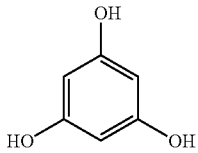

phloroglucinol dihydrate,

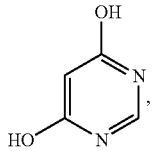

4,6-dihydroxypyrimidine,

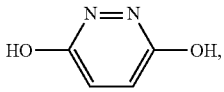

3,6-dihydroxypyridazine,

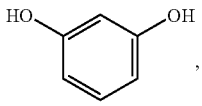

1,3-dihydroxybenezene,

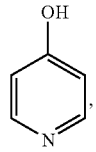

4-hydroxypyridine,

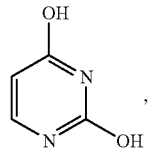

2,4-dihydroxypyrimidine,

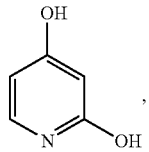

2,4-dihydroxypyridine,

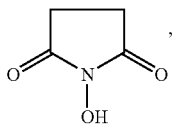

N-hydroxysuccinimide,

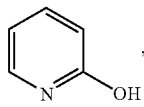

2-hydroxypyridine,

-continued

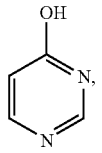

4-hydroxypyrimidine,

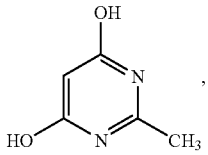

4,6-dihydroxy-2-methylpyrimidine,

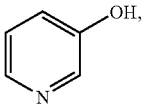

3-hydroxypyridine,

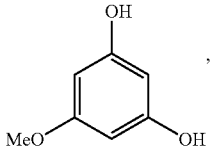

1,3-dihydroxy-5-methoxybenzene,

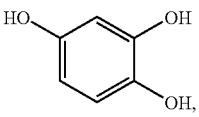

1,2,4-trihydroxybenzene,

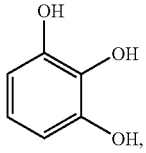

1,2,3-trihydroxybenzene,

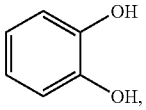

1,2-dihydroxybenzene,

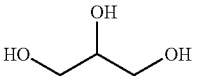

, methanol, glucose, sucrose, glycerol,

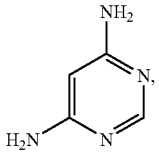

4,6-diaminopyrimidine,

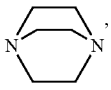

1,4-diazabicyclo[2.2.2]octane,

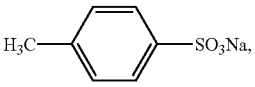

4-toluenesulfonic acid,
sodium salt,

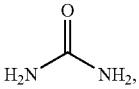

urea,

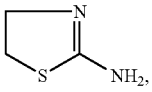

2-amino-2-thiazoline,

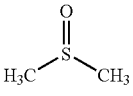

methyl sulfoxide and

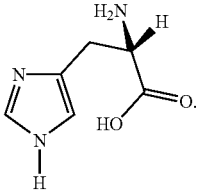

L-histidine.

The electrolyte solutions of the present invention can also include a mixture of organic additives having at least one hydroxy group with organic additives that do not contain at least one hydroxy group.

All of the above-mentioned organic additives are useful with or without the presence of cobalt in the electrolyte. Cobalt is a known additive to electrowinning electrolytes for the purpose of reducing lead corrosion and reducing anode potential. In the substantial absence of cobalt, the scope of this invention also includes the use of ethylene glycol and ethanol as organic additives. The substantial absence of cobalt means, for purposes of this description, a cobalt concentration less than 5 ppm.

The organic additive may be added to the electrolyte solution in an amount sufficient to reduce or substantially eliminate the formation of a gas at a gas-evolving anode. Preferably, organic additive is added in an amount sufficient to reduce gas evolution at the anode by 10% or more by comparison with the same electrolytic process (i.e., an otherwise similar electrolyte and electrolytic cell) without the organic additive, more preferably by 50% or more.

Advantageously, the organic additives of the present invention are effective at relatively low concentration. The amount of organic additive required is process dependent and often organic additive specific. Typically, the organic additive is about 2% or less by weight of the total electrolyte solution. The amount of organic additive added to the electrolyte solution is generally be about 100 ppm to about 50,000 ppm. Preferably, the amount of organic additive is about 100 ppm to about 20,000 ppm. More preferably, the amount of organic additive is about 100 ppm to about 10,000 ppm.

Electrolytic Cell

The present invention provides an electrolytic cell having at least one gas-evolving anode; at least one cathode; and electrolyte solution that is in contact with at least one gas-evolving anode. The electrolyte solution comprises (i) acid; (ii) metal ion source; (iii) solvent; and (iv) at least one organic additive as described above.

The anode comprises a material that is insoluble in the electrolyte solution. Metal anodes are typically classified into two groups: (1) chlorine-generating anodes where saleable products are produced at the anode, and (2) oxygen-evolving anodes that facilitate a desired cathodic reaction. The present invention is particularly suitable for the oxygen-evolving anodes. Oxygen-evolving anode materials include lead, zinc, steel, platinized titanium, and dimensionally stable anodes consisting of titanium coated with mixed metal oxides of titanium and/or platinum-group metals.

Lead anodes with lead oxide coatings and lead alloys are the most prevalent anodes. Anodes are commonly made of lead (Pb) or an appropriate alloy of lead or other substitution. Some examples of alloys include Pb—Sb, Pb—Ca, Pb—Sr, Pb—Ca—Sn, and Pb—Sr—Sn. One alloy that is used frequently is Pb—Sn—Ca (~98.5% Pb, 1.35% Sn and 0.065% Ca). The Pb—Sn—Ca alloy forms a coherent corrosion layer on its surface so that contamination of the cathode copper by Pb is minimal. See generally Metal Anodes, Kirk-Othmer Encyclopedia of Chemical Technology, 4$^{th}$ Ed.; John Wiley & Sons; New York, 1995; pp. 244-257.

The electrical circuit in an electrochemical cell is completed by the connection between the anode and cathode, which is assisted by the electrolyte solution. For the current to flow, the electrolyte solution must be electrically conductive. Ions in the electrolyte solution make it electrically conductive.

Other common ingredients may be added to the electrolyte solution. These other ingredients can be used, for example, to improve the structure and quality of the deposit on the cathode. Other ingredients preferably are compatible with the other components of the electrolyte solution. Other ingredients may be added as is known in the art and include, but are not limited to, leveling agents (e.g., glue), grain refiners (e.g., thiourea and chloride), smoothing agents, and surfactants (e.g., fluorochemical surfactants) such as those described in U.S. Pat. No. 5,468,353 (Anich et al.).

Electrolytic Processes

The electrolyte solutions and methods of the present invention are useful for various electrolytic processes using a gas-evolving anode. For example, the organic additives can be employed in electrolyte solutions used for electrowinning, electrogalvanizing, copper foil production, metal finishing, and metal recovery.

Electrowinning is used to produce a variety of highly pure metals, such as nickel, cobalt, copper, zinc, manganese, etc. Typically, electrowinning is carried out in large, open-topped tanks having a plurality of flat electrode plates suspended into the electrolyte solution from the top of the tank. A number of these tanks are usually housed in a building known as a tank house.

Electrogalvanized steel is produced by electrodepositing an adhering zinc film on steel sheet or wire. In this process, steel strip or wire is continuously fed through suitable entry equipment, a series of washes and rinses, and an electrolyte solution. The equipment may be similar to that described for copper foil production (below). In other equipment, the sheet or wire is charged in a similar fashion around a cathodic drum immersed in the electrolyte solution. The steel passes between anodes while immersed in the electrolyte solution to be galvanized on both sides. Either an acid zinc sulfate or cyanide zinc electrolyte solution is used. Grain refiners are usually added to help produce a fine, tight knit zinc surface on the steel. (ASM Handbook, Formerly 9$^{th}$ Ed. Metals Handbook, Vol. 13. Corrosion; ASM International; Materials Park, Ohio, 1987; pp. 765-767. Modem Electroplating, 4$^{th}$ Ed. Wiley & Sons, New York, 2000; pp. 423-460.)

Copper foil, typically used in the electronics industry for circuit board production, is usually produced electrolytically. Copper is plated continuously onto a cylindrical, rotating cathodic drum. The drum, with its axis roughly level with the top of an electrolyte solution, is smooth stainless steel or titanium that allows the copper foil to be peeled away as the foil exits the electrolyte solution. A curved anode conforms to the shape of the drum in order to maintain a consistent gap between the anode and cathode. A uniform and consistent gap is necessary to maintain uniform current densities that then deliver a uniformly thick and consistent copper foil. Typical copper plating processing cannot be used with a dissolving copper anode because the gap between the anode and cathode could not be maintained. Typical copper electrolyte solutions comprise sulfuric acid, copper sulfate, and ingredients for brightening and grain refining. (Metal Anodes, Kirk-Othmer Encyclopedia of Chemical Technology, 4$^{th}$ Ed., Vol. 16; John Wiley & Sons; New York, 1995; pp. 244-257.)

Metal finishing is an example of electroplating. In some cases for electroplating, the metal being plated cannot be used as a sacrificial anode because it either dissolves rapidly in the electrolytic solution or it forms an insoluble insulating coating that prevents the slow dissolution of the anode. Chromium plating is an example of metal finishing utilizing insoluble lead alloy anodes. Chromium plating is typically done in tanks with anodes hanging, from copper anode rods, around two outside edges of the tank. Work pieces to be plated, hanging from copper cathode rods, are then placed between the anodes and current applied. Chromic acid and other ingredients are used in the electrolytic solution. Chromic acid mist is highly toxic and generated in the plating process. Nickel plating is another process for which lead anodes are sometimes used. (Metals Handbook, 9$^{th}$ Ed., Vol. 5 Surface Cleaning, Finishing, and Coating; ASM American Society for Metals, Metals Park, Ohio, 1982; pp. 170-198, p. 211. Modem Electroplating, 4$^{th}$ Ed., Wiley & Sons, New York, 2000; pp. 289-360.)

Metal recovery is similar to electrowinning, except it removes metals from waste streams. Cathodes are starter sheets of the metal being plated or of stainless steel blanks from which the recovered metal can be stripped. Anodes include lead, graphite, or titanium. As the metal concentration in the electrolyte solution is decreased, the current efficiency and quality of the plates decrease, techniques of agitation and/or high surface area cathodes may be used in attempt to alleviate these problems. (Metals Handbook, 9$^{th}$ Ed., Vol. 5 Surface Cleaning, Finishing, and Coating; American Society for Metals, Metals Park, Ohio, 1982; p. 319. Modern Electroplating, 4$^{th}$ Ed., Wiley & Sons, New York, 2000; pp. 806-808.)

The metals obtained from the inventive electrowinning processes can contain small concentrations of the organic additives. For example, copper obtained by electrowinning in the inventive process can contain organic additive at a concentration of at least one ppm, typically in the range of 1-1,000 ppm.

EXAMPLES

Features and advantages of this invention are further illustrated in the following Examples. It is to be expressly understood, however, that the particular ingredients and amounts used as well as other conditions and details are not to be construed in a manner that would unduly limit the scope of this invention. Percentages cited are by weight unless otherwise specified.

TABLE 1

List of Materials, all available from Sigma-Aldrich Co., Milwaukee, Wisconsin.

| Component |
|---|
| 1,4-dihydroxybenzene-5-sulfonic acid, potassium salt |
| 1,3-dihydroxy-5-methoxybenzene |
| 3,5-dimethoxyphenol |
| 1,3-dihydroxynapthalene |
| 1,3,5-trihydroxybenzene dihydrate |
| 1,2,3-trihydroxybenzene |
| 1,2,4-trihydroxybenzene |
| tetrahydroxy-1,4-quinone hydrate |
| N-hydroxy-succinimide |
| 4-hydroxypyridine |
| 2-hydroxypyridine |
| 2,6-dihydroxypyridine |
| 2,4-dihydroxypyridine |
| 2-hydroxypyrimidine hydrochloride |
| 4-hydroxypyrimidine |
| 4,6-dihydroxypyrimidine |
| 2,4,6-trihydroxypyrimidine |
| 4,6-dihydroxy-2-methylpyrimidine |

TABLE 1-continued

| List of Materials, all available from Sigma-Aldrich Co., Milwaukee, Wisconsin. Component |
|---|
| 4,6-dihydroxy-2-methylmercaptopyrimidine |
| 2,4,5-trihydroxypyrimidine |
| 3,4-dihydroxy-9,10-dioxo-2-anthracenesulfonic acid, sodium salt monohydrate (Alizarin Red S monohydrate) |
| 4-toluenesulfonic acid, sodium salt |
| 3,6-dihydroxypyridazine |
| 1,4-diazabicyclo[2.2.2]octane |
| 4,6-diaminopyrimidine |
| 2-amino-2-thiazoline |
| methylviologen chloride |
| Pyrazine |
| methyl sulfoxide |
| L-histidine |
| Lignosulfonate |
| Fe(o-phenanthroline)$_3$SO$_4$ |

Electrowinning Cell #1

An electrowinning cell constructed of clear polyvinyl chloride (PVC), with dimensions of 8.5 centimeters (cm)×13.5 cm×19.5 cm, contained an array of 2 lead anodes surrounding 1 copper cathode, each with dimensions of 9.0 cm high by 7.5 cm wide by 0.1 cm thick. Prior to performing each electrowinning experiment, the lead anodes were placed in a 2% nitric acid solution for 2 minutes, removed, then abraded with a Scotchbrite abrasive pad to remove lead oxide on the surface. The electrodes were placed into slots (0.2 cm×0.2 cm×11 cm) cut into the side of the electrowinning cell at 1.2 cm intervals to hold the electrodes at a regular spacing and connected by a wire to metal buss bars (19 cm×1.0 cm×0.8 cm) bolted to each 19.5 cm long side of the cell. The power to the cells was provided using a DC power supply (model PD18-10AD; Kenwood, Tokyo, Japan). The positive lead was connected to the lead anode(s) and the negative lead connected to the copper cathode(s). The electrowinning cell was charged with 1380.0 grams of electrolyte (prepared by adding to a 1000 ml volumetric flask: 500 ml (557 grams) of a 20% wt/vol copper sulfate solution, then adding 200.0 grams of 93% sulfuric acid (technical grade) to the volumetric flask, and deionized water, to the mark, to bring the total volume to 1000 ml).

Comparative Example C-1 and Examples 1-9

The electrowinning cell #1 was immersed in a constant temperature water bath to maintain the electrolyte temperature at about 40° C. The electrolyte was stirred with a 1.0 cm×3.8 cm diameter polyethylene impeller (containing 3 equally spaced radial slots with dimensions 3.8 cm long by 0.3 cm wide by 0.3 cm deep) connected by a DELRIN™ shaft (available from E. I. DuPont DeNemours & Co.; Wilmington, Del.) (20.3 cm long×0.6 cm diameter) to an electric stirring motor (controller—Barnant Model 750-4550, mixing head—Barnant Model 750-5050; available from Barnant Co., Barrington, Ill.) set to 500 rotations per minute (rpm). The impeller was positioned at the back of the electrowinning cell, away from the electrodes.

The DC power supply was set to maintain a constant current level of 3.50 amps to the cell. The voltage was increased slowly until this current level was reached. To maintain the desired constant current in the electrowinning cell required an applied DC voltage in the range of 2.01 to 2.09 volts. All tests in this series were run in the constant current (galvanostatic) mode. At this voltage and current level there were considerable amounts of oxygen gas evolved at the lead anodes. The cell was operated for 10 minutes at these conditions.

After 10 minutes of operation, organic additive (5.0 grams; 3600 ppm; see complete listing in Table 2 below) was placed into the area of the stirring motor shaft and allowed to mix into the electrolyte. Gas evolution (by visual observation) and cell voltage were recorded during each test. After 40 minutes of operation, current flow to the cell and stirring was stopped, and the electrolyte was drained from the cell. Results are listed in Table 2.

Example 10

The procedures followed for Example 10 were identical to those for Examples 1-9 with the exception that additives Alizarin Red S monohydrate (2.0 grams) and 1,3,5-trihydroxybenzene dihydrate (5.0 grams) were added to the electrolyte.

TABLE 2

| Example | Additive | $O_2$ Gas Evolution | Lowest Cell Voltage (ΔV) |
|---|---|---|---|
| C-1⊠⊠ | Benzoquinone | N/C | N/A |
| 1 | 1,4-dihydroxybenzene-5-sulfonic acid potassium salt | ** | 2.04 (.01) |
| 2 | 3,5-dimethoxyphenol | ** | 1.75 (0.32 |
| 3 | 1,3-dihydroxynapthalene | *** | 2.03 0.02 |
| 4 | 1,3,5-trihydroxybenzene dihydrate | *** | 1.68 (0.33) |
| 5⊠ | tetrahydroxy-1,4-quinone hydrate | ** | 2.06 (0.03) |
| 6 | 4,6-dihydroxypyrimidine | *** | 1.66 (0.37) |
| 7 | 2,4,6-trihydroxypyrimidine | *** | 2.06 (−0.02) |
| 8 | 2,4,5-trihydroxypyrimidine | * | 2.01 (0.01 |
| 9 | 3,6-dihydroxypyridazine | *** | 1.74 (0.28) |
| 10 | 1,3,5-trihydroxybenzene dihydrate; 3,4-dihydroxy-9,10-dioxo-2-anthracene-2-sulfonic acid monohydrate (in the weight ratio of 2/5) | *** | 1.58 (0.45) |

⊠forms foam layer
⊠⊠insoluble
*slight reduction
**moderate reduction
***significant reduction
N/C = no change
N/A = not applicable In Table 2, some examples are described as "forms foam layer." This essentially means that a foam blanket (one that is substantially connected) was formed on the surface of the electrolyte between the two electrodes.

"Insoluble" essentially means insoluble by visual observation using the unaided human eye.

A "slight reduction" in $O_2$ gas evolution essentially means a slight reduction in gas evolution. In such a case, the electrolyte surface between the anode and the cathode showed evidence of considerable mixing. However, when the volume between the two electrodes is illuminated with a light source, it was apparent that the convective mixing was diminished to the point that there is a small amount of clear, non-turbid electrolyte near the surface of the cathode.

A "moderate reduction" in $O_2$ gas evolution essentially means a moderate decrease in gas evolution. In such a case, there was a marked decrease in the surface electrolyte disturbance to the degree that it was evident that the gas bubbles are not reaching the cathode. Visual examination of the space between the electrodes, with the aid of an overhead light source, showed that the gas evolution was clearly not reaching the cathode and that half of the space/volume between the electrodes was clear and non-turbid.

A "significant reduction" in $O_2$ gas evolution essentially means a significant decrease in the gas evolution. In such a case, the gas evolution was diminished to the point that it appears that the electrolyte surface was completely undisturbed. Visual examination of the electrolyte with the aid of an overhead light source shows that the electrolyte contained between the electrodes was completely clear and the only evidence of gas evolution was a very thin film of gas at the surface of the lead anode.

"N/C" or "no change" essentially means that the electrolyte surface between the anode and cathode was vigorously disturbed. Once the cell reaches its normal operating potential (2.0 volts DC), the amount of gas being evolved at the anode causes a considerable amount of convective mixing in the cell due to the spacing of the two electrodes. This can be easily observed in the cell by placing a small flashlight above the electrowinning cell to illuminate electrolyte contained in the space between the two electrodes. In the control or no additive condition, the entire volume of electrolyte between the electrodes took on a turbid appearance due to the presence of the oxygen bubbles in the electrolyte.

In the data presented, $\Delta V = V_{initial} - V_{final}$.

One-Hour Plating Procedure

Example C-2

A series of one-hour plating tests was run to determine the effect of the 1,3,5-trihydroxybenzene dihydrate on current and plating efficiency in the electrowinning cell. The methods described in Examples 1-12 were used with the following exceptions:

(1) in order to allow continuous flow of electrolyte to the cell surfaces, a variable speed peristaltic pump (available from VWR Scientific, West Chester, Pa.) set at a flow rate of 40 milliliters per minutes (mL/minute) was added. Liquid was pumped from a reservoir of electrolyte in a 20 liter polyethylene tank which was maintained at about 40° C. by immersion of the reservoir in a heated stainless steel water bath.

(2) the electrolyte contained Cu (44.6 g/l of electrolyte), sulfuric acid (192.8 g/l of electrolyte), Fe (Fe++ 0.19 g/l of electrolyte and Fe+++ 0.86 g/l of electrolyte) and Co (0.14 g/l of electrolyte). The electrowinning cell was run for one hour and initial and final cathode weights were measured in order to determine total deposition of copper. The results are listed in Table 3.

Example 11

The method described in Example C-2 above was used with the exception that 1,3,5-trihydroxybenzene dihydrate was added to the electrolyte in a concentration of 1000 ppm.

Example 12

The method described in Example C-2 above was used with the exception that 1,3,5-trihydroxybenzene dihydrate was added to the electrolyte in a concentration of 3000 ppm.

TABLE 3

Copper Deposition and Current Efficiency of Electrowinning Cell with Varied 1,3,5-trihydroxybenzene dihydrate Concentrations.

| Description | Concentration of 1,3,5-trihydroxybenzene dihydrate (ppm) | Cu Deposited (grams per hour (g/hr)) | Current Efficiency* (%) |
|---|---|---|---|
| Example C-2 | 0 | 3.96 | 95.4 |
| Example 11 | 1000 | 4.02 | 96.9 |
| Example 12 | 3000 | 4.07 | 98.1 |

*A cell operating at a 100% current efficiency would theoretically deposit 4.15 g/hr of copper.

The results listed in Table 3 show that the addition of 1,3,5-trihydroxybenzene dihydrate to the electrolyte significantly increases the current efficiency of the Cu electrowinning cell.

Comparative Example C-3 and Examples 13-32

Electrowinning Cell #2 for Quantitative Measurement of Gas Evolution and Voltages Effects of electrowinning additives on gas evolution and voltage were quantified using the following electrowinning cell. A one-liter Pyrex wide mouth jar, with a plastic screw top cap fitted with electrodes, thermocouple, stainless steel gas port and VITON™ seal served as the electrowinning cell. The electrodes consisted of two copper cathodes and one lead alloy anode each having dimensions of 2 inches (5 cm) in width by 3 inches (7.6 cm) in height. The thermocouple used was a Type K (available from Omega Engineering Inc., Stamford, Conn.). The jar was charged with copper electrolyte (prepared the same as for Electrowinning Cell #1 described above). Additives to be tested were charged at 5.0 g/L). The plastic cap was screwed onto the jar, immersing the electrodes completely and thermocouple approximately 2.0 cm in the electrolyte. The power to the electrodes was supplied by a 0-8 volt, 5 amp power supply (available from Lambda Electronics, San Diego, Calif.). Tests were run at about 40° C. Mixing and temperature were controlled using a water bath, magnetic stirrer/heat plate and a TEFLON™ stirring bar. Target current densities were controlled using current control and fluctuating voltage. When the current reached a constant value, the voltage was set to approximately 2.00V. All gases released from the cell were routed through a dry ice trap to remove condensable gases, and non-condensable gas measured in ml/min at STP using a DryCal DC-2 Flow Calibrator (available from BIOS International, Butler, N.J.). Base line measurements on the electrolyte were taken just prior to addition of test additives. Minimum gas evolution rate, minimum voltage and the identity of the additive used are listed in Table 4.

TABLE 4

| Example | Additive | Gas Evolution Rate (mL/min) | Minimum Voltage (ΔV) |
|---|---|---|---|
| C-3 | No additive | 9.100 | 1.99 (—) |
| 13 | 3,4-dihydroxy-9,10-dioxo-2-anthracenesulfonic acid, sodium salt monohydrate | 3.700 | 1.98 (0.04) |
| 14 | 1,3-dihydroxybenzene | 1.334 | 1.88 (0.11) |
| 15 | 4-hydroxypyridine | 1.809 | 1.79 (0.20) |
| 16 | 2,4-dihydroxypyrimidine | 1.087 | 1.87 (0.12) |

TABLE 4-continued

| Example | Additive | Gas Evolution Rate (mL/min) | Minimum Voltage (ΔV) |
|---|---|---|---|
| 17 | 2,4-dihydroxypyridine | 0.742 | 1.65 (0.33) |
| 18 | N-hydroxysuccinimide | 1.652 | 1.90 (0.07) |
| 19 | 2-hydroxypyridine | 0.475 | 1.84 (0.13) |
| 20 | 2,6-dihydroxypyridine | 2.029 | 1.98 (0.00) |
| 21 | 4-hydroxypyrimidine | 1.868 | 1.91 (0.08) |
| 22 | 4,6-dihydroxy-2-methylpyrimidine | 1.240 | 1.84 (0.12) |
| 23 | 2-hydroxypyrimidine hydrochloride | 1.083 | 1.92 (0.05) |
| 24 | 4,6-dihydroxy-2-methylmercaptopyrimidine | 1.208 | 2.07 (−0.05) |
| 25 | 3-hydroxypyridine | 0.487 | 1.88 (0.12) |
| 26 | 1,3-dihydroxy-5-methoxybenzene | 0.973 | 1.77 (0.17) |
| 27 | 1,2,4-benzenetriol | 0.812 | 1.73 (0.26) |
| 28 | 1,2,3-trihydroxybenzene | 1.032 | 1.83 (0.19) |
| 29 | 1,2-dihydroxybenzene | 1.256 | 1.90 (0.13) |
| 30 | quinhydrone | 3.433 | 1.98 (0.04) |
| 31 | 4,6-diaminopyrimidine | 0.753 | 1.90 (0.14) |
| 32 | methyl sulfoxide | 2.660 | 1.90 (0.12) |

The above data shows a reduction in gas evolution in the range of about 60 to 90%. This would reduce the formation of acid mist and consequent air pollution emissions or the extent of required pollution abatement processes and equipment.

Comparative Example C-4

The procedure described for electrowinning cell #2 was followed for Comparative Example C-4, with the exception that 700.0 mL of Zn electrolyte (prepared by adding to a 1000 mL volumetric flask: 454 grams of ZnSO4.7H2O, then adding 300.0 grams of 93% technical grade sulfuric acid to the volumetric flask, and deionized water, to the mark) was used instead of Cu electrolyte and the voltage was set to approximately 3.07 V. Gas evolution rates, minimum voltages, voltage differences (ΔV) and the identity of the additive used are listed in Table 5.

Example 33

The procedure described for Comparative Example C-4 was followed for Example 33, with the exception that 5.0 g/L of 4,6-dihydroxypyrimidine was added to the cell. Minimum gas evolution rates, minimum voltages, voltage differences (ΔV) and the identity of the additive used are listed in Table 5.

TABLE 5

| Example | Additive | Gas Evolution Rate mL/min | Minimum Voltage (ΔV) |
|---|---|---|---|
| C-4 | No Additive | 12.55 | 3.07 (—) |
| 33 | 4,6-dihydroxyprimidine | 9.77 | 2.94 (.13) |

The results listed in Table 5 indicate that the addition of 4,6-dihydroxypyrimidine, at the concentration of 5.0 g/L, to a Zn electrowinning cell significantly reduces both the gas evolution rate and the cell voltage.

Comparative Examples C-5-C-7 and Examples 34-45

Electrowinning Cell #3

A 70 mL jar (3.5 cm diameter) equipped with a magnetic stir bar was placed in a water bath and then placed on a stirrer-hot plate. The jar was filled with electrolyte (50 mL; to a depth of about 5 cm; prepared the same as for Electrowinning Cell #1 described above). Stirring, enough to give a slight vortex, is initiated and the electrolyte temperature is brought to about 40° C. The electrodes (one cathode and one anode;obtained from Sargent-Welch, Buffalo Grove, Ill. Copper cathode: 1.9 cm×12.8 cm, used as received; lead anode: 1.9 cm×12.8 cm, degreased with LPS Presolve Cleaner/Degreaser (available from LPS Laboratories, Tucker, Ga.), and then burnished with a paper towel before use) were then immersed in the electrolyte. Electrodes were typically immersed to a depth of about 4.0 cm, and spaced approximately 1 cm apart. The electrodes were supplied power from a dc power supply Model GPS-1830D (available from Cole-Parmer, Vernon Hills, Ill.). The lead electrode was conditioned by electrolysis in the electrolyte from 15 to 30 minutes at 2.00 V. When the current reached a constant value, current was set to be the limiting control at 2.00 V. A strip chart recorder was also attached to the electrodes to monitor the voltage. Additives were added neat and directly to the cell in between the electrodes. Liquid additives were added using 1 cc syringes. Sequential amounts were added after the time noted in the table, yielding the voltage reductions listed in Table 6 and 7.

TABLE 6

Non-aromatic compounds

| Ex | Compound | Total Amount Organic Additive | Voltage (V) | Time (min) | $O_2$ Gas Evolution |
|---|---|---|---|---|---|
| C-5 | Lignosulfonate | 0.084 g | 2.00 | | N/C |
| 34 | Ethanol | 0.30 mL | 1.87 | 4 | ** |
| | | 0.60 mL | 1.84 | 7 | ** |
| | | 0.90 mL | 1.83 | 17 | ** |
| | | 1.90 mL | 1.79 | | ** |
| 35 | Methanol | 0.30 mL | 1.89 | | ** |
| | | 0.60 mL | 1.86 | | ** |
| 36 | Ethylene glycol | 0.30 mL | 1.76 | 4 | ** |
| | | 0.60 mL | 1.71 | 7 | ** |
| | | 0.90 mL | 1.68 | 17 | *** |
| | | 1.90 mL | 1.63 | 83 | *** |
| 37 | Urea | 0.201 g | 1.96 | 2 | * |
| | | 0.409 g | 1.94 | 6 | ** |
| | | 0.602 g | 1.93 | 9 | ** |
| | | 0.805 g | 1.92 | 11 | ** |
| | Amount of Glucose | 0.500 g | 1.82 | 16 | ** |
| | added to 0.805 g | 1.000 g | 1.71 | 18 | ** |
| | of urea | 1.500 g | 1.66 | 20 | *** |
| 38 | Glucose | 0.284 g | 1.95 | | * |
| | | 0.588 g | 1.84 | | ** |
| 39 | | 1.118 g | 1.80 | | ** |
| | 1,4- | 0.218 g | 1.74 | | ** |
| | diazabicyclo[2.2.2]octane | 0.317 g | 1.72 | | ** |
| 40 | Sucrose | 0.291 g | 1.82 | 5 | ** |
| | | 0.579 g | 1.71 | 10 | ** |
| 41 | Glycerol | 0.50 mL | 1.62 | | *** |
| 42 | 2-amino-2-thiazoline | 0.251 g | 1.81 | | ** |

TABLE 7

Aromatic Compounds

| Ex | Compound | Amount | Voltage (V) | Time (min) | $O_2$ Gas Evolution |
|---|---|---|---|---|---|
| C-6 | Methylviologen chloride | 0.080 g | Current dropped | | N/C |
| C-7 | $Fe(o\text{-}phen)_3SO_4$ | 1 mL .025 M | 2.00 | | N/C |
| 43 | Pyrazine | 0.084 g | 1.95 | | * |
| 44 | Histidine | 0.251 g | 1.91 | 10 | ** |
| 45 | 4-toluenesulfonic acid, sodium salt | 0.100 g | 1.95 | | * |
| | | 0.298 g | 1.87 | 1 | ** |
| | | 0.498 g | 1.82 | | ** |

Another advantage of the inventive process is the capacity to produce more metal at a given cell voltage. By increasing current flow at a given voltage (e.g., 2.0V) metal (e.g., Cu) production at the cathode can be increased in the same equipment.

Example 46

The procedure described for Comparative Example C-3 was followed for Example 46, with the exception that the cathodes were weighed before and after a 60 minute plating run, and that the cell was operated at a constant voltage of 2.0 volts throughout the duration of the plating run. 4,6-dihydroxypyrimidine was added to the cell to a concentration of 5.0 g/L in Example 43. Voltages, maximum current observed and the amount of copper deposited are given below.

Weight of Cu deposited from electrolyte without organic additive:

| | | |
|---|---|---|
| Cathode A: | 1.2025 g. | 2.0 v, 2.16 amps |
| B: | 1.1530 g. | |
| Total Cu deposited: | 2.3555 g | |

With 5 g/l 4,6-DHP electrolyte, Cu deposit after 1 hr.:

| | | |
|---|---|---|
| Cathode A: | 1.5848 g. | 2.0 v, 2.92 amps |
| B: | 1.6605 g. | |
| Total Cu deposited: | 3.2453 g | |

Various modifications and alterations of this invention will become apparent to those skilled in the art without departing from the scope and spirit of this invention, which is indicated by the following claims.

What is claimed is:

1. An electrowinning process utilizing an electrolytic cell having at least one gas-evolving insoluble anode, at least one cathode, and an electrolyte solution in contact with said anode and cathode and comprising an acid, a metal ion source and a solvent, said process comprising applying an electrical potential between said anode and said cathode to induce current flow wherein said electrolyte solution contains at least one organic additive in an amount sufficient to reduce cell operating potential at constant current, compared to the same process without such organic additive, said organic additive being selected from the group consisting of: quinhydrone; 1,4-dihydroxybenzene-5-sulfonic acid, potassium salt; 3,5-dimethoxyphenol; 1,3-dihydroxynaphthalene; phloroglucinol dihydrate; tetrahydroxy-1,4-quinone hydrate; 4,6-dihydroxypyrimidine; 2,4,5-trihydroxypyrimidine; 3,4-dihydroxy-9,10-dioxo-2-anthracenesulfonic acid, sodium salt monohydrate; 3,6-dihydroxypyridazine; 1,3-dihydroxybenzene; 4-hydroxypyridine; 2,4-dihydroxypyrimidine; 2,4-dihydroxypyridine; N-hydroxysuccinimide; 2-hydroxypyridine; 4-hydroxypyrimidine; 4,6-dihydroxy-2-methylpyrimidine; 2-hydroxypyrimidine hydrochloride; 3-hydroxypyridine; 1,3-dihydroxy-5-methoxybenzene; 1,2,4-trihydroxybenzene; 1,2,3-trihydroxybenzene; 1,2-dihydroxybenzene; 4,6-diaminopyrimidine; 1,4-diazabicyclo[2,2,2]octane; 2-amino-2-thiazoline; methyl sulfoxide; L-histidine; and mixtures thereof.

2. The electrowinning process of claim 1 in which the organic additive is selected from the group consisting of: 3,5-dimethoxyphenol; phloroglucinol dihydrate; 4,6-dihydroxypyrimidine; 3,6-dihydroxypyridazine; 1,3-dihydroxybenzene; 4-hydroxypyridine; 2,4-dihydroxypyrimidine; 2,4-dihydroxypyridine; N-hydroxysuccinimide; 2-hydroxypyridine; 4-hydroxypyrimidine; 4,6-dihydroxy-2-methylpyrimidine; 3-hydroxypyridine; 1,3-dihydroxy-5-methoxybenzene; 1,2,4-trihydroxybenzene; 1,2,3-trihydroxybenzene; 1,2-dihydroxybenzene; 4,6-diaminopyrimidine; 1,4-diazabicyclo[2,2,2]octane; 2-amino-2-thiazoline; methyl sulfoxide; L-histidine; and mixtures thereof.

3. The process of claim 2 wherein the organic additive is 4,6-dihydroxypyrimidine.

4. The electrowinning process of claim 1 which is copper electrowinning, zinc electrowinning or manganese electrowinning.

5. The electrowinning process of claim 1 in which the anode is comprised of lead or a lead alloy.

6. The process of claim 1 in which the metal ion source is a metal salt.

7. The process of claim 6 in which the metal salt is selected from the group consisting of copper sulfate, zinc sulfate, manganese sulfate, and nickel sulfate.

8. The process of claim 1 wherein said solvent comprises water and a polar organic solvent.

9. An electrowinning process utilizing an electrolytic cell having at least one gas-evolving insoluble anode, at least one cathode, and an electrolyte solution in contact with said anode and cathode and comprising an acid, a metal ion source and a solvent, said process comprising applying an electrical potential between said anode and said cathode to induce current flow wherein said electrolyte solution contains at least one organic additive in an amount sufficient to reduce gas evolution at the anode, compared to the same process without such organic additive, said organic additive being selected from the group consisting of: 4,6-diaminopyrimidine; 1,4-diazabicyclo [2,2,2]octane; 2-amino-2-thiazoline; methyl sulfoxide; L-histidine; and mixtures thereof.

10. The electrowinning process of claim 9 wherein the process is copper electrowinning, zinc electrowinning, or manganese electrowinning.

11. The process of claim 9 in which the anode is comprised of a material selected from the group consisting of lead and lead alloys.

12. The process of claim 9 in which the metal ion source is a metal salt.

13. The process of claim 12 in which the metal salt is selected from the group consisting of copper sulfate, zinc sulfate, manganese sulfate, and nickel sulfate.

14. The process of claim 9 wherein the metal ion source is chromic acid.

15. The process of claim 9 in which the solvent comprises water and a polar organic solvent.

16. An electrowinning process utilizing an electrolytic cell having at least one gas-evolving insoluble anode, at least one cathode, and an electrolyte solution in contact with said anode and cathode and comprising an acid, a metal ion source and a solvent, said process comprising applying an electrical potential between said anode and said cathode to induce current flow wherein said electrolyte solution contains at least one organic additive in an amount sufficient to reduce gas evolution at the anode, compared to the same process without such organic additive, said organic additive being selected from the group consisting of: quinhydrone; 1,4-dihydroxybenzene-5-sulfonic acid, potassium salt; 3,5-dimethoxyphenol; 1,3-dihydroxynaphthalene; phloroglucinol dihydrate; tetrahydroxy-1,4-quinone hydrate; 4,6-dihydroxypyrimidine; 2,4,6-trihydroxypyrimidine; 2,4,5-trihydroxypyrimidine; 3,4-dihydroxy-9,10-dioxo-2-anthracenesulfonic acid, sodium salt monohydrate; 3,6-dihydroxypyridazine; 1,3-dihydroxybenzene; 4-hydroxypyridine; 2,4-dihydroxypyrimidine; 2,4-dihydroxypyridine; N-hydroxysuccinimide; 2-hydroxypyridine; 2,6-dihydroxypyridine; 4-hydroxypyrimidine; 4,6-dihydroxy-2-methylpyrimidine; 2-hydroxypyrimidine hydrochloride; 4,6-dihydroxy-2-methylmercaptopyrimidine; 3-hydroxypyridine; 1,3-dihydroxy-5-methoxybenzene; 1,2,4-trihydroxybenzene; 1,2,3-trihydroxybenzene; 1,2-dihydroxybenzene; 4,6- diaminopyrimidine; 1,4-diazabicyclo[2,2,2]octane; 2-amino-2-thiazoline; methyl sulfoxide; L-histidine; and mixtures thereof.

17. The electrowinning process of claim 16 in which the organic additive is selected from the group consisting of: quinhydrone; 1,4-dihydroxybenzene-5-sulfonic acid, potassium salt; 3,5-dimethoxyphenol; 1,3-dihydroxynaphthalene; phloroglucinol dihydrate; tetrahydroxy-1,4-quinone hydrate; 4,6-dihydroxypyrimidine; 2,4,5-trihydroxypyrimidine; 3,4-dihydroxy-9,10-dioxo-2-anthracenesulfonic acid, sodium salt monohydrate; 3,6-dihydroxypyridazine; 1,3-dihydroxybenzene; 4-hydroxypyridine; 2,4-dihydroxypyrimidine; 2,4-dihydroxypyridine; N-hydroxysuccinimide; 2-hydroxypyridine; 2,6-dihydroxypyridine; 4-hydroxypyrimidine; 4,6-dihydroxy-2-methylpyrimidine; 2-hydroxypyrimidine hydrochloride; 4,6-dihydroxy-2-methylmercaptopyrimidine; 3-hydroxypyridine; 1,3-dihydroxy-5-methoxybenzene; 1,2,4-trihydroxybenzene; 1,2,3-trihydroxybenzene; 1,2-dihydroxybenzene; 4,6-diaminopyrimidine; 1,4-diazabicyclo[2,2,2]octane; 2-amino-2-thiazoline; methyl sulfoxide; L-histidine; and mixtures thereof.

18. An electrowinning process utilizing an electrolytic cell having at least one insoluble anode, at least one cathode, and an electrolyte solution in contact with said anode and cathode and comprising an acid, a metal ion source and a solvent, and having a substantial absence of cobalt in the electrolyte solution, said process comprising applying an electrical potential between said anode and said cathode to induce current flow wherein said electrolyte solution contains at least one organic additive in an amount sufficient to reduce gas evolution at the anode, compared to the same process without such organic additive, said organic additive being selected from the group consisting of: 4,6-diaminopyrimidine; 1,4-diazabicyclo[2,2,2]octane; 2-amino-2-thiazoline; methyl sulfoxide; L-histidine; and mixtures thereof.

19. A copper electrowinning process utilizing an electrolytic cell having at least one gas-evolving insoluble anode, at least one cathode, and an electrolyte solution in contact with said anode and cathode and comprising an acid, a copper ion source and a solvent, said process comprising applying an electrical potential between said anode and said cathode to induce current flow wherein said electrolyte solution contains at least one organic additive in an amount sufficient to increase the rate of copper deposition on the cathode at constant voltage, compared to the same process without such organic additive, said organic additive being selected from the group consisting of: quinhydrone; 1,4-dihydroxybenzene-5-sulfonic acid, potassium salt; 3,5-dimethoxyphenol; 1,3-dihydroxynaphthalene; phloroglucinol dihydrate; tetrahydroxy-1,4-quinone hydrate; 4,6-dihydroxypyrimidine; 2,4,5-trihydroxypyrimidine; 3,4-dihydroxy-9,10-dioxo-2-anthracenesulfonic acid, sodium salt monohydrate; 3,6-dihydroxypyridazine; 1,3-dihydroxybenzene; 4-hydroxypyridine; 2,4-dihydroxypyrimidine; 2,4-dihydroxypyridine; N-hydroxysuccinimide; 2-hydroxypyridine; 4-hydroxypyrimidine; 4,6-dihydroxy-2-methylpyrimidine; 2-hydroxypyrimidine hydrochloride; 3-hydroxypyridine; 1,3-dihydroxy-5-methoxybenzene; 1,2,4-trihydroxybenzene; 1,2,3-trihydroxybenzene; 1,2-dihydroxybenzene; 4,6-diaminopyrimidine; 1,4-diazabicyclo[2,2,2]octane; 2-amino-2-thiazoline; methyl sulfoxide; L-histidine; and mixtures thereof.

* * * * *

UNITED STATES PATENT AND TRADEMARK OFFICE

CERTIFICATE OF CORRECTION

PATENT NO. : 7,384,533 B2
APPLICATION NO. : 10/192335
DATED : June 10, 2008
INVENTOR(S) : Michael J. Sierakowski It is certified that error appears in the above-identified patent and that said Letters Patent is hereby corrected as shown below:

Title Page, Item (56) In Book Excerpt: Lupi et al. (Other Publications)
Line 22, after "Electrotechnologies" insert -- : --.

Column 3
Line 7, delete "WO/0065 131" and insert in place thereof -- WO/0065131 --.

Column 7
Line 46, delete "oraganic" and insert in place thereof -- organic --.

Column 14
Line 28, delete "1.75 (0.32" and insert in place thereof -- 1.75 (0.32) --.

Line 29, delete "2.03 0.02" and insert in place thereof -- 2.03 (0.02) --.

Line 35, delete "2.01 (0.01" and insert in place thereof -- 2.01 (0.01) --.

Column 17
Line 62, delete "dihydroxyprimidine" and insert in place thereof
-- dihydroxypyrimidine --.

Column 18
Line 1, delete "C-5-C-7" and insert in place thereof -- C-5–C-7 --.

UNITED STATES PATENT AND TRADEMARK OFFICE

CERTIFICATE OF CORRECTION

PATENT NO. : 7,384,533 B2
APPLICATION NO. : 10/192335
DATED : June 10, 2008
INVENTOR(S) : Michael J. Sierakowski It is certified that error appears in the above-identified patent and that said Letters Patent is hereby corrected as shown below:

Column 21

Line 28, in claim 16, delete "4,6- diaminopyrimidine;" and insert in place thereof -- 4,6-diaminopyrimidine; --.

Signed and Sealed this

Fourteenth Day of October, 2008

JON W. DUDAS
*Director of the United States Patent and Trademark Office*